United States Patent [19]

Adams

[11] Patent Number: 4,552,620

[45] Date of Patent: Nov. 12, 1985

[54] PAPER MACHINE BELT

[75] Inventor: Richard J. Adams, Rockton, Ill.

[73] Assignee: Beloit Corporation, Beloit, Wis.

[21] Appl. No.: 533,309

[22] Filed: Sep. 19, 1983

[51] Int. Cl.[4] ..... D21F 3/02

[52] U.S. Cl. ..... 162/358; 100/151; 428/311.1; 428/314.2; 428/314.4; 428/315.5; 428/315.7

[58] Field of Search ..... 162/358, 360.1, DIG. 1; 428/314.4, 311.1, 315.5, 315.7, 314.2; 156/137; 100/151, 153

[56] References Cited

U.S. PATENT DOCUMENTS

| | | | |
|---|---|---|---|
| 4,224,372 | 9/1980 | Romanski | 162/DIG. 1 |
| 4,227,254 | 10/1980 | Gill | 162/358 |
| 4,229,253 | 10/1980 | Cronin | 162/358 |
| 4,238,287 | 12/1980 | Gill | 162/358 |
| 4,267,299 | 5/1981 | Oechsle | 528/48 |
| 4,300,982 | 11/1981 | Romanski | 162/358 |

*Primary Examiner*—Peter Chin

*Attorney, Agent, or Firm*—Hill, Van Santen, Steadman & Simpson

[57] ABSTRACT

An endless impervious, oil, abrasion and crush resisting belt for paper making machinery such as presses, especially of the extended nip type, calender rolls, and the like has a woven fiber base, such as scrim, and a urethane coating impregnating the base providing an integral layer of substantial thickness with pores forming a granite like finish providing excellent paper release properties. The surface finish of the belt can be modified with subsequent grinding and coating treatments and can be grooved if desired. The belt is formed by looping an endless scrim blanket around driving rollers providing a travelling run which is sprayed with a two component polyurethane coating which quickly gels to accommodate building up of a layer of the desired thickness by controlling the fluid flow and the speed of the travelling run.

7 Claims, 12 Drawing Figures

PAPER MACHINE BELT

BACKGROUND OF THE INVENTION

1. Field of the Invention:

This invention relates to belts for various components of paper making machines which carry and protect the paper as it passes through pressure nips and then gently release the paper. Specifically, the invention deals with paper supporting and conveying belts for components of paper making machinery which are formed from a woven fabric endless loop blanket spray-coated on one or both sides with a urethane coating which impregnates and seals the blanket and having pores providing a finished paper receiving surface with good paper release properties.

2. Prior Art:

Hertofore paper supporting belts for paper making machinery were provided in the form of felted fiber or plastics material blankets such as rubber and the like. In those instances where the plastics material blanket contained a fabric, the plastics material was applied by doctoring a flowable plastics formulation onto the fabric and then curing the coated fabric to form a dense coating free from voids presenting a smooth continuous paper receiving surface. As these belts convey the paper through pressure nips, they are subject to very heavy loads and they must be rigid enough so that they will not crush under the loads and yet pliable enough to wrap around rolls and the like. The necessary pliability could heretofore only be obtained by controlling the plastics material formulations so that they cure to a relatively soft resilient condition that would flow and flatten under nip loads to shift and crush the paper. Further, desirable high nip pressures could not be tolerated.

It would then be an improvement in this art to provide relatively hard and firm but pliable belts conveying paper through high pressure nips of paper machine components with pores or voids in the belts controlled in size to produce desired resilience and paper receiving surfaces which freely release the paper after the pressure nip treatment.

SUMMARY OF THE INVENTION

According to this invention, paper machine belts for conveying paper through pressure nips of paper making machine components are formed from a woven fabric base, such as scrim, and a spray coating of solvent free two component urethane resin. The belts are hard and firm to resist crushing under high nip loads but remain pliable through a long wear life to conform with the contours of the paper machine components around which they are looped. The urethane coating impregnates the fabric base and has a limited range of pores presenting a surface finish similar to granite which will release the paper without damage. This surface can be ground to a polished finish, grooved to discharge water squeezed from the paper, and coated with a gloss finish resin, if desired. The belt itself is impervious to water and while it is sufficiently pliable to flex around paper machine rolls, shoes, and the like, it is hard enough to sustain very high nip pressures without flattening or flowing relative to the paper. Durometer hardnesses to 70–90 on the A scale are desirable. Since the sprayed-on urethane coating thoroughly impregnates the woven fiber base, the belt has a unitary construction and will not separate into the fabric and resin layers even after a very long usage involving reverse bending and lapping conditions.

In a preferred belt, the pores will range from 0.019 to 0.185 millimeters in diameter with the majority of the pores in the range of 0.037 to 0.074 millimeters. The magnitude of the pores is controlled so that they remain separated or isolated from each other to avoid the opening up of larger voids or pockets. A stone-like texture is thus obtained.

The belts are impervious to liquids, highly resistant to oil, and highly resistant to abrasions such as might occur from their contacts with rollers, shoes and the like paper machinery components.

The belts are formed by looping an endless blanket of woven fabric, such as scrim, around driving rolls to provide an elongate travelling run. The blanket is formed to the desired length and width for the particular paper machine component to receive the finished belt. A spray gun is mounted over the travelling run of the blanket to traverse the width of the blanket and discharge a relatively flat jet of quick jell solventless two component urethane resin formulation on the travelling run. The resin formulation is of the two component solventless type formed from isocyanate-terminated prepolymers cured with polyols and catalysts. The prepolymer and the catalysts are delivered into a mixing chamber, intimately admixed and immediately fed to the spray gun. Suitable formulation and mixing conditions are disclosed in the Oechsle U.S. Pat. No. 4,267,299.

The speed of the travelling run of the blanket and the speed of traverse of the gun together with the flow rate through the gun are regulated to produce a coating of the desired thickness. Coatings of about 0.1 to 0.3 inches thick are preferred. The thickness of the woven fabric is in the range of 0.05 to 0.15 inches.

The spray coat is preferably applied in a warm condition so that it will jell at room temperature in about five to fifteen seconds and will completely cure in about seven days.

The desired coating thickness can be built up from one or more passes of the travelling run of the blanket under the spray gun.

If desired, the fabric can be coated on both the inner and outer faces of the loop.

It is then an object of this invention to provide hard, wearable, abrasion and oil resisting, impervious paper machinery belts for conveying and protecting paper as it passes through high pressure nips of paper machine components.

Another object of this invention is to provide a press belt for paper making machinery having a fabric base and a hard urethane paper receiving layer impregnated on the base containing isolated small pores providing a stone-like texture.

Another object of the invention is to provide urethane belts for paper making machinery which have a stone-like texture to resist nip pressures and easily and smoothly release paper pressed thereon.

A further object of the invention is to provide a method of making urethane belts for paper machines.

A specific object of the invention is to provide a method of spray coating fabric blankets to provide urethane belts for paper making machinery.

Other and further objects and features of this invention will become apparent to those skilled in this art from the following detailed description of the annexed sheets of drawing which show best mode examples of this invention.

BRIEF DESCRIPTION OF THE ILLUSTRATED EMBODIMENTS

Figure 1:
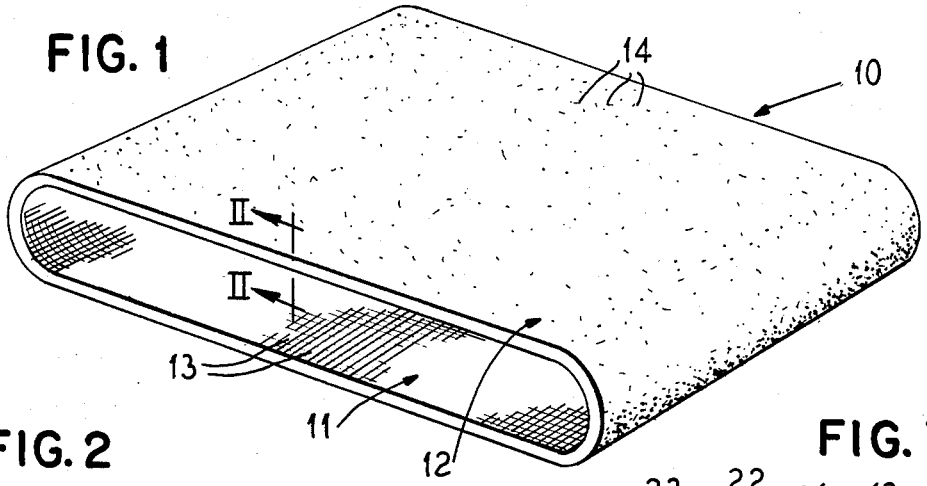
FIG. 1 is an isometric side and top view of an endless paper machine urethane belt according to the invention.
Figure 2:
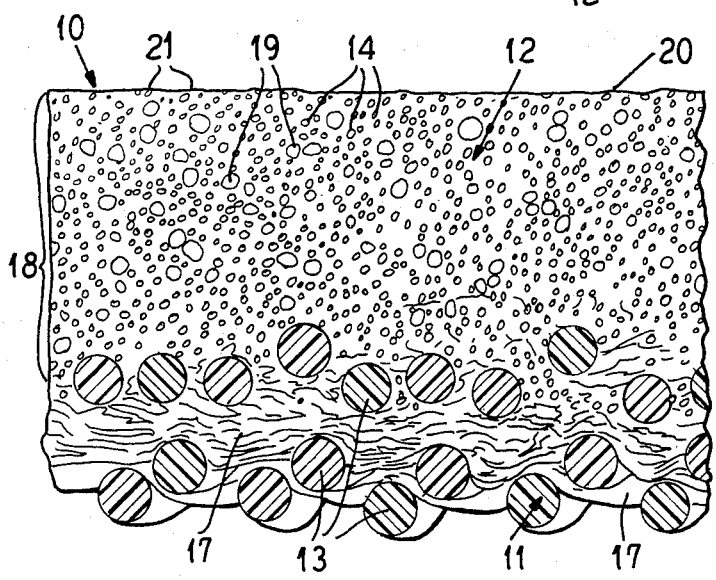
FIG. 2 is a greatly enlarged fragmentary cross-sectional view taken along the line II—II of FIG. 1.
Figure 4:
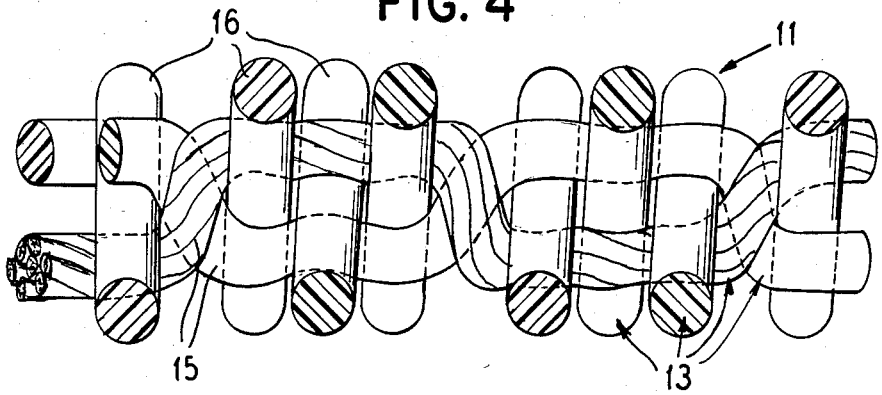
FIG. 4 is a greatly magnified edge view of a preferred weav for the fabric of the belt.

The belt 10 of FIGS. 1 and 2 is a continuous or endless loop composed of a woven fabric base 11 and a urethane coating 12 impregnating the base and forming a layer on the outer face of the blanket. The fabric 11 has woven strands or filaments 13 and the urethane coating 12 has isolated pores or bubbles 14 providing a stone-like texture to the coating. The belt may have any desired length and width to fit paper machine components. The fabric weave base 11, as best shown in FIG. 4, is preferably of a type having good flexibility in the longitudinal or lengthwise direction and more rigidity in the transverse direction. Further, some of the filaments are of the monofilament type while others are of the twisted strand type. As FIG. 4 attempts to illustrate, the fibers 13 forming the blanket base 11 include warp strands 15 and woof strands 16, some of which are monofilaments, but others are twisted fiber, such as cotton cords. These twisted cords are useful in maintaining the urethane on the scrim while it is setting. The weave pattern may vary, but as illustrated, the woof strands 16 are grouped in bundles of three while the warp strands 15 cross-over between the bundles providing flexing zones. The monofilament warp strands may be formed of plastic material such as a polyester while the woof strands may be formed of twisted cotton or plastics material yarn of monofilament plastic. It should be appreciated, of course, FIG. 4 is somewhat diagrammatic and that the open zones between the strands 13 are filled with plastics material since the fabric base 11 is impregnated with the coating 14 to a substantial depth of at least one-half the thickness of the scrim.

As shown in FIG. 2, the coating 12 impregnates the fabric base 11 substantially through the entire thickness thereof filling the voids between the strands as illustrated at 17. As shown, some of the strands are exposed in the bottom face of the belt. The voids between the strands provide paths for release of air or liquid in the nip areas when the belt is used in paper machine press roll assemblies. Then the coating extends above the top face of the base 11 to a desired height forming a continuous layer 18. This layer has a myriad of the small isolated closed bubbles or pores 14 and some scattered larger below surfaces bubbles 19 providing a stone-like closed texture. The surface 20 of the layer 18 is relatively smooth and flat but does have minute undulations 21 provided by the pores 14 at the surface of the layer. This surface firmly supports the paper but does not stick to the paper thus providing for quick and easy release of the paper after it passes through a pressure nip.

The pores 14 and 19 are sufficiently spaced apart so as to be isolated from each other preventing the opening up of larger cavities. The pore size and magnitude is controlled by the spray process to provide pores in an overall range of 0.019 to 0.185 millimeters in diameter with a majority of the pores lying in the range of 0.037 to 0.074 millimeters in diameter.

Figure 3:
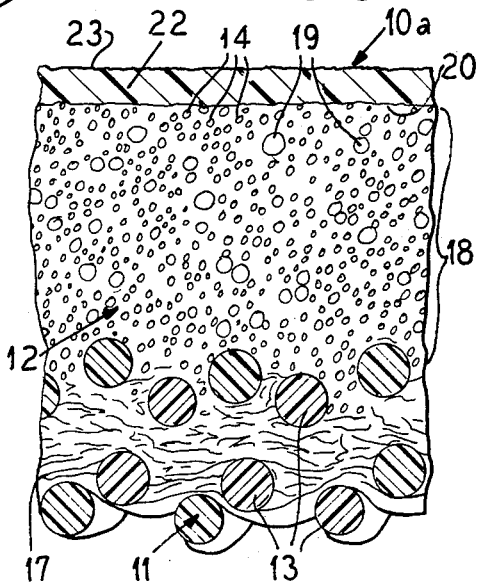
FIG. 3 is a view similar to FIG. 2, but showing a modified belt equipped with a gloss finish coat.

FIG. 3 illustrates a modified belt **10*a* with parts and features corresponding to the belt 10 being marked with the same reference numerals. However, in the belt 10*a* the surface 20 of the urethane layer 18 is covered with a more dense urethane coating 22 providing a gloss finish 23 for the surface of the belt. This coating 22** can be a denser urethane resin relatively free from bubbles or pores or can be composed of other resin formulations.

Figure 3A:
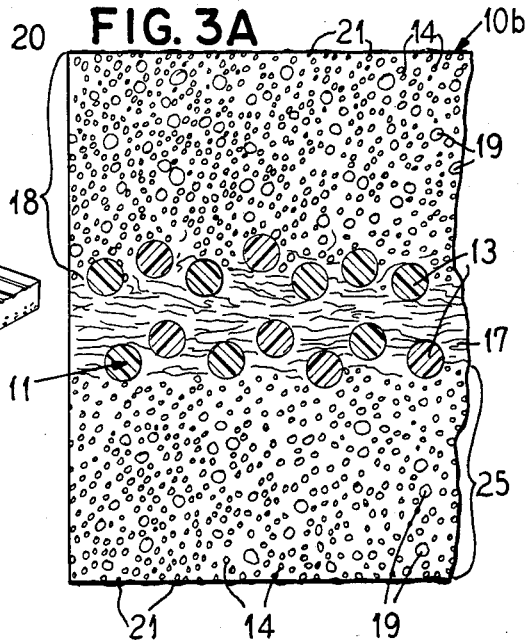
FIG. 3A is a view similar to FIG. 2, but showing another modified belt having coatings on both sides of the fabric.

As illustrated in FIG. 3A, a still further modified belt **10*b* is provided with a second urethane layer 25** on the inner face of the belt so that the woven fabric base is covered on both faces with continuous coatings to a thickness of 0.1 to 0.3 inches.

Figure 3B:
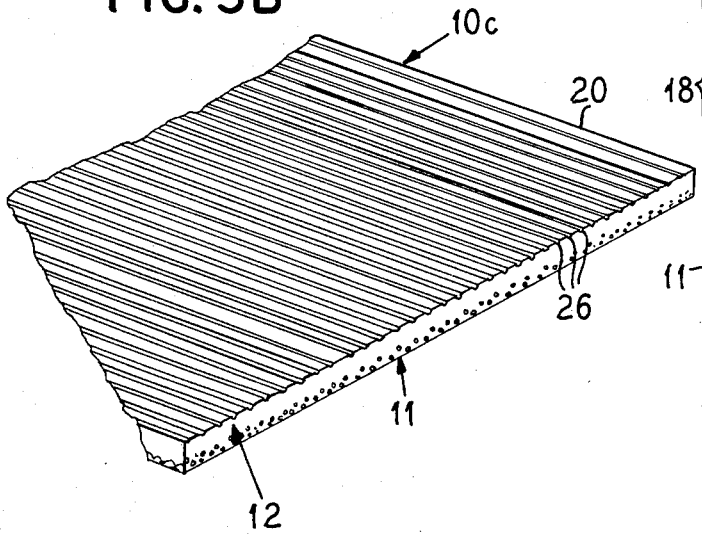
FIG. 3B is a fragmentary top and edge view of another modified belt of this invention having grooves in the top surface thereof.

As shown in the fragmentary plan view of FIG. 3B, a further modified belt **10*c* is provided by milling the surface 20 to form grooves 26** extending longitudinally around the belt. If desired, blind drilled holes could be used in place of or all of the grooves.

Figure 5:
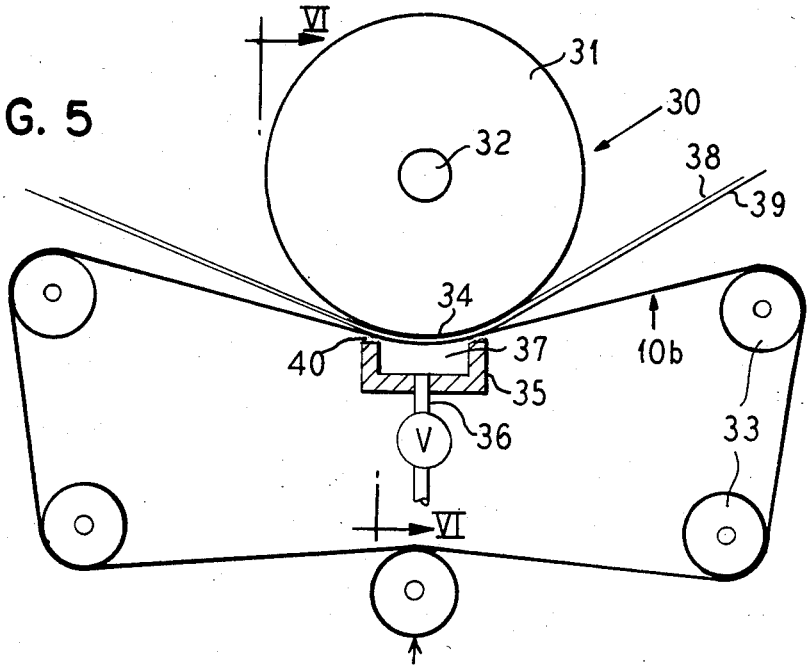
FIG. 5 is a somewhat schematic side view of an extended nip paper making machine press having a belt of this invention.
Figure 6:
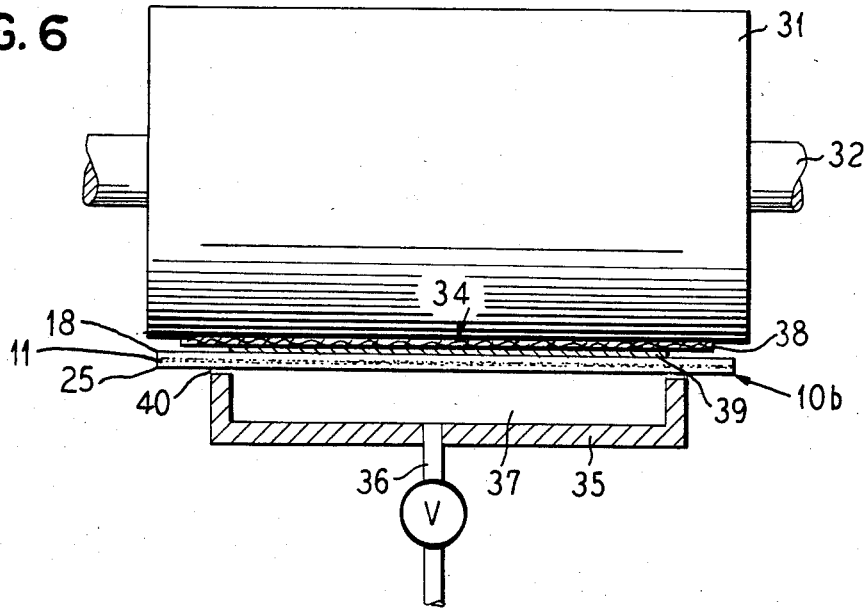
FIG. 6 is a fragmentary cross-sectional view along the line VI—VI of FIG. 5.
Figure 7:
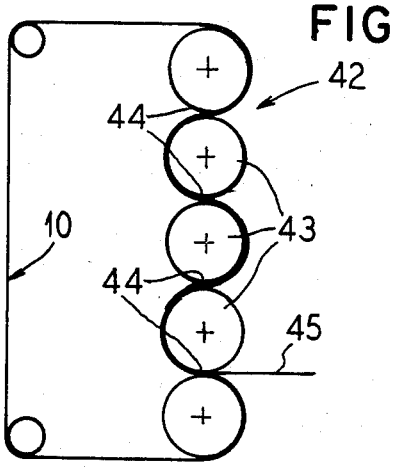
FIG. 7 is a somewhat schematic view of a paper machine cylinder roll stack provided with a belt of this invention.

As illustrated in FIGS. 5–7, the belts of this invention are useful in many different types of pressure nip equipment of paper making and paper finishing machines.

Thus, as shown in FIGS. 5 and 6 the belt **10*b* with coatings on both faces is used in an extended nip press 30 of a paper making machine. The press 30 includes a press roll 31 rotatable about an axis 32 extending transversely of the press section. The belt 10*b* coated on both faces with urethane layers 18 and 25 is trained around pulley rolls 33 to guide the belt about a portion of the press roll 31 to form an arcuate press area or nip 34. One of the pulley rolls 33** is shiftable to adjust the tension of the belt.

An arcuate press shoe 35 is positioned within the loop of the belt **10*b* opposite the roll 31 at the press area 34. The shoe 35 is pressed against the belt and to insure an even pressure across the belt in this area while minimizing sliding friction, hydraulic pressure is supplied through a pipe 36 to a cavity 37 in the shoe. In an alternative arrangement, the shoe can be solid with an arcuate surface mating with the roll 31. The urethane layer 25** rides on the shoe.

A felt 38 is trained around the roll 31 passing between the roll and the belt **10*b*. A web of material, such as paper 39, is carried on the underface of the felt 38 to be covered by the belt 10*b* at the press zone 34. The paper engages the urethane layer 18. After the paper and felt emerge from the pressure zone or nip 34, the felt is directed away from the belt 10***b* to carry the web 39 therewith.

As best shown in FIG. 6, the belt 10*b* rides on the shoe 35 while hydraulic pressure in the shoe creates a very high pressure nip squeezing the paper between the belt 10*b* and the felt 38.

Since the belt travels over the shoe, lubricating channels 40 can be provided in the shoe forming films of oil on which the belt 10*b* rides.

Very high nip pressures are maintained in the press 30 over a relatively wide pressure nip zone provided by the pressure roll 31 and the shoe 35. The belt 10*b* covers the paper 39 on its entire path through the pressure nip zone and the surface texture of the belt being, as described above, of a stone-like character smoothly and fully supports the paper web through this passage while at the same time not sticking to the paper so as to be easily released therefrom after passage through the nip zone.

It will, of course, be understood that the belt 10*b* could be replaced with the belts 10, 10*a* and 10*c* as described above. The gloss coat on the belt 10*a*, will tend to polish the paper, and the grooves in the belt 10*c* will release air or water at the nip area. If single face coated belts 10 and 10*a* are used in extended nip presses, they would be turned inside out from the illustrated positions of FIGS. 1, 2, and 3 to ride the coated sides on the shoe 35 and the felt 38 would be interposed between the scrim side of the belt and the paper, or the paper would be sandwiched between the felt 38 and a second felt.

As shown in FIG. 7 a calender stack 42 composed of five superimposed rolls 43 has a belt 10 of this invention threaded through the four pressure nips 44 provided by the stack of five rolls. A paper web 45 is threaded through the nips 44 from the bottom to the top and is covered by the belt 10. The belt resists the pressure nip loads and protects and carries the paper through the nips.

Figure 8:
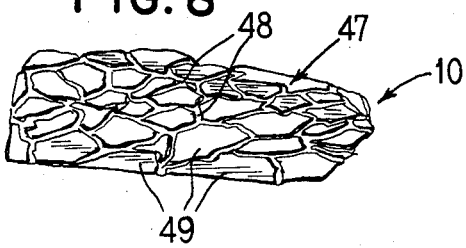
FIG. 8 is a magnified plan view of a portion of the belt surface attempting to show the stone texture.

As illustrated in FIG. 8, the coated surface of the belt 10 has a stone-like texture 47 with seams 48 between solid zones 49. This texture facilitates paper release without opening up voids which would make the belt porous.

Figure 9:
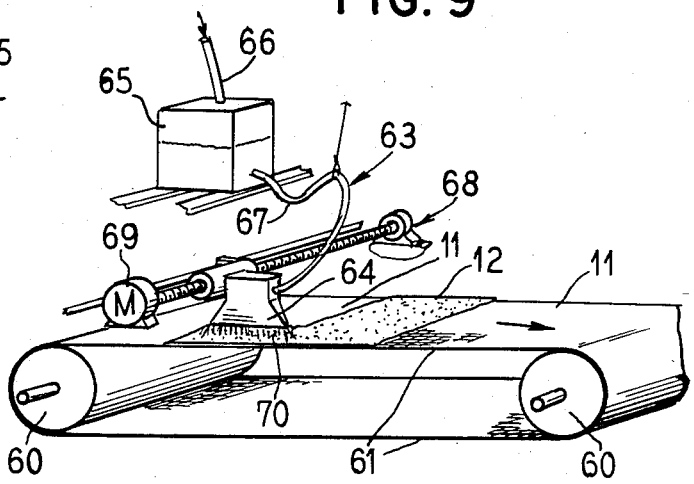
FIG. 9 is an isometric side view illustrating apparatus for making the belt of FIGS. 1 and 2.
Figure 10:
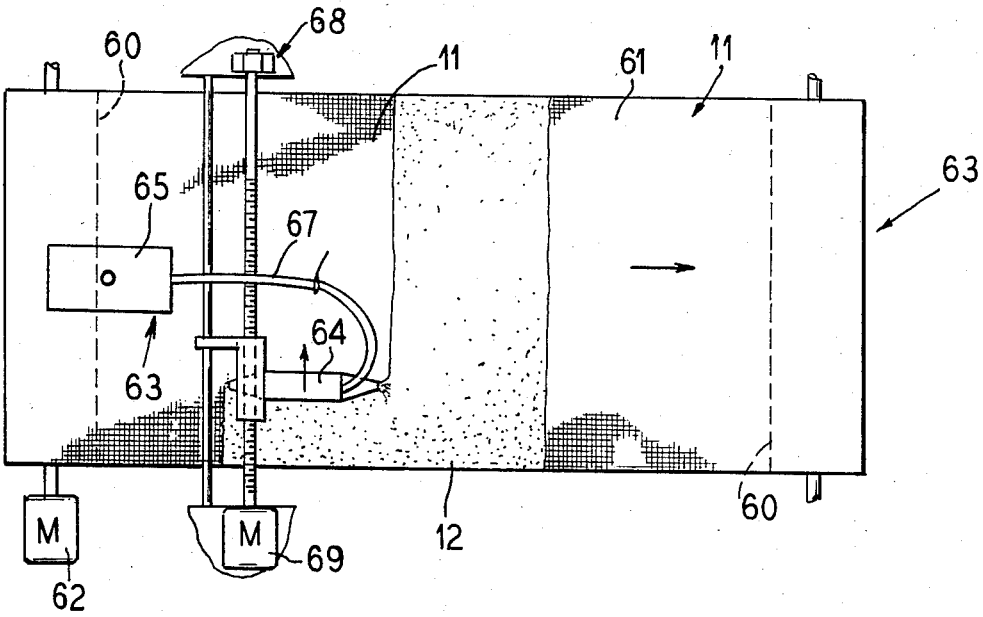
FIG. 10 is a plan view of FIG. 9.

As illustrated in FIGS. 9 and 10, the belt 10 of this invention is easily and conveniently formed by training the endless fabric base blanket 11 around rolls 60 to provide elongated travelling runs 61 of the belt between the rolls. One of the rolls 60 is driven by an electric motor 62 driving the top run 61 from the left to the right.

Urethane spray apparatus 63 includes a spray nozzle 64, a mixing tank 65, an air pressure inlet 66 for the tank, a flexible hose 67 joining the lower portion of the tank with the nozzle 64, and a transverse support 68 for the nozzle 64. This support 68 conveniently takes the form of a screw rod driven by an electric motor 69.

The arrangement is such that the motor 62 drives the belt at a desired rate of speed to move the top run 61 under the spray nozzle 64. The two component urethane resin mix is forced from the tank 65 through the nozzle 64 to eject a wide narrow jet 70 of the urethane material against the top face of the fabric blanket forcing the urethane into any voids in the blanket and building up the urethane layer 12 to a desired height. The resin formulation quickly gels on the top run 61 and the belt may be driven through several cycles for applying successive coats of the urethane material. In addition, the screw rod 68 is driven at a speed to move the spray nozzle transversely across the top face of the run 61 to cover the entire width of the blanket base 11 with the resin. Speeds of the motors 62 and 69 are controlled so that the entire outer face of the belt receives the spray coating to the desired depth.

The gloss coated belt 10*a* of FIG. 3 is made by spraying the gloss coat layer 22 over the layer 18 in apparatus 63.

The modified belt 10*b* of FIG. 3A is made by turning the coated belt 10 inside out and repeating the spray procedure to form the second coat 25. The coated face is ground flat on each face to hold the belt thickness to a close tolerance with the scrim at a constant depth from the surfaces.

The grooves 26 of the belt 10*c* of FIG. 3B can be formed by milling or grinding the surface 20 of the coat 12 to a desired depth of 0.05 to 0.125 inches.

If desired, the set urethane coating 12 and the gloss coat can be polished to a desired finish.

From the above descriptions, it will be apparent to those skilled in this art that this invention provides an improved paper machine belt having a fabric base and a urethane coat which supports and protects paper webs passing through high pressure nips.

I claim as my invention:

1. A belt for conveying and covering paper webs passing through pressure nips of paper making machines which comprises an endless looped blanket of woven fabric and an integral continuous impervious layer of urethane plastics material covering the paper web receiving face of the blanket and penetrated into the woven fabric providing an inseparable bond uniting the fabric and layer, said layer having closed isolated pores throughout the thickness thereof and a ground finished granite stone-like surface receiving the web, said surface having pores ranging in size from 0.019 to 0.185 mm uncovered at said surface and said belt having a durometer hardness of at least 70 on the A scale.

2. The belt of claim 1 wherein the fabric is scrim composed of monofilament twist yarn threads and the plastics layer leaves some of the yarns exposed.

3. The belt of claim 1 wherein said layer is on both faces of the fabric.

4. The belt of claim 1 wherein the layer has a thickness of about 0.1 to 0.3 inches and the fabric has a thickness of about 0.05 to 0.15 inches.

5. In combination with paper machinery defining a paper receiving nip, the improvement of an impervous hard travelling support belt conveying the paper through the nip and having a continuous urethane resin finished surface with small isolated uncovered pores ranging in size from 0.019 to 0.185 mm providing a granite stone-like texture, and said belt having a durometer harness of at least 70 on the A scale.

6. The combination of claim 5 wherein the paper machinery defining a paper receiving nip is an extended nip shoe and the finished surface rides on said shoe.

7. A paper machine impervious, hard non-crushable belt for supporting a paper web through a pressure nip which comprises an endless looped scrim blanket spray coated and impregnated with a solventless two component urethane resin formulation, said coating extending continuously over the entire paper web receiving face of the belt, small isoltaed pores in said coating ranging in size from 0.019 to 0.185 mm uncovered at the surface of the web receiving face providing a granite stone texture for easy release of the paper after passage through the nip, and said belt having a durometer hardness of at least 70 on the A scale.

* * * * *